US009307824B1

(12) United States Patent
Al-Moumen

(10) Patent No.: US 9,307,824 B1
(45) Date of Patent: Apr. 12, 2016

(54) MULTI-FUNCTIONAL BAG WITH CUSHION

(71) Applicant: Abdulmohsen A. Y. M. A. Al-Moumen, Al Andalus (KW)

(72) Inventor: Abdulmohsen A. Y. M. A. Al-Moumen, Al Andalus (KW)

( * ) Notice: Subject to any disclaimer, the term of this patent is extended or adjusted under 35 U.S.C. 154(b) by 0 days.

(21) Appl. No.: 14/726,397

(22) Filed: May 29, 2015

(51) Int. Cl.
*A45F 4/02* (2006.01)
*A45F 3/04* (2006.01)

(52) U.S. Cl.
CPC ... *A45F 4/02* (2013.01); *A45F 3/04* (2013.01); *A45F 2004/026* (2013.01)

(58) Field of Classification Search
CPC ..... A45F 2004/026; A45F 4/02; A45F 3/04; A45F 4/06; A45F 2003/122; A45F 4/00; A45C 9/00; A45C 4/52; A42B 1/067; A41D 5/04
USPC ..... 224/181, 186, 188, 190, 586, 153, 155, 224/156, 575–577, 584; 2/69, 69.5, 86, 93, 2/94, 108, 209.13; 5/640, 417, 419–420, 5/652, 656–657
See application file for complete search history.

(56) References Cited

U.S. PATENT DOCUMENTS

| | | | | |
|---|---|---|---|---|
| 3,774,825 | A | 11/1973 | Schone et al. | |
| 5,411,192 | A * | 5/1995 | Xiao | A45F 4/02 108/42 |
| 5,527,088 | A * | 6/1996 | MacLean | A47C 4/52 224/155 |
| 5,560,524 | A | 10/1996 | Brune | |
| 5,573,155 | A * | 11/1996 | Sadler | A45F 4/02 224/153 |
| 5,676,293 | A * | 10/1997 | Farris | A45F 3/04 2/175.7 |
| 5,779,112 | A * | 7/1998 | Krulik | A45C 9/00 224/155 |
| 5,988,465 | A | 11/1999 | Vitale et al. | |
| 6,354,477 | B1 * | 3/2002 | Trummer | A45C 3/02 224/153 |
| 6,692,072 | B2 * | 2/2004 | Nelson | A47D 15/006 297/129 |
| 6,729,519 | B2 | 5/2004 | Kestler | |
| D509,653 | S | 9/2005 | Yu | |
| 8,123,090 | B2 * | 2/2012 | Missick | A45F 4/02 224/153 |
| 8,556,139 | B2 | 10/2013 | Almoumen | |
| 8,556,140 | B2 | 10/2013 | Almoumen | |
| 8,690,031 | B1 | 4/2014 | Blakley et al. | |
| 2005/0050614 | A1 * | 3/2005 | Leung | A41D 3/08 2/209.13 |
| 2009/0084821 | A1 * | 4/2009 | Lenzi | A45F 3/08 224/155 |

FOREIGN PATENT DOCUMENTS

| | | |
|---|---|---|
| GB | 2 197 582 A | 5/1988 |

* cited by examiner

*Primary Examiner* — Adam Waggenspack
(74) *Attorney, Agent, or Firm* — Richard C. Litman

(57) ABSTRACT

The multi-functional bag with cushion includes a pack portion, similar to a conventional backpack, having a front panel and a rear panel defining an open interior region, along with a pair of shoulder straps secured to the back panel. A cushion is provided having a fixed end and a free end, with the fixed end being secured to a top end of the rear panel of the pack portion. At least one belt extends from the cushion for releasable attachment of the cushion to a chair or the like. A rigid plate is contained within the cushion, adjacent the fixed end thereof, preventing slippage of the cushion when the multi-functional bag with cushion is supported on a chair back or the like. The cushion is pleated, including a plurality of laterally extending fellable pockets and a plurality of pleats separating the pockets from each other.

5 Claims, 7 Drawing Sheets

MULTI-FUNCTIONAL BAG WITH CUSHION

BACKGROUND OF THE INVENTION

1. Field of the Invention

The present invention relates generally to carry bags and the like, and particularly to a backpack type bag with an integral, multi-functional cushion.

2. Description of the Related Art

Backpacks are commonly used by students and others who carry heavy loads, such as books, papers and the like. Backpacks are also favored by many who transport relatively light loads but prefer to do so in a hands-free or relatively unobstructed manner. Backpacks are also favored by individuals who may be required to sit for relatively long periods of time without the benefit of a comfortable chair and at times without even a bench or clean and dry surface to sit on. In view of the increased popularity of backpacks and the need for comfort by a large number of students and others who are frequently forced to sit on uncomfortable wood or metal chairs, there have been a number of attempts to combine the benefits of a backpack with a built-in ground cloth or padded cushion. Such designs, though, typically include a backpack in combination with a basic cushion, or simply a padded backpack to be used as both a bag and a cushion.

It would be desirable to provide a backpack or similar bag with a multi-functional cushion that could be used with a wide variety of different support surfaces, including a wide variety of different styles of chairs, benches and the like. Thus, a multi-functional bag with cushion solving the aforementioned problems is desired.

SUMMARY OF THE INVENTION

The multi-functional bag with cushion includes a pack or backpack portion, similar to a conventional backpack, having a front panel and a rear panel defining an open interior region, along with a pair of shoulder straps secured to the back panel. A cushion is provided having a fixed end and a free end, with the fixed end thereof being secured to a top end of the rear panel of the pack portion. At least one belt extends from the cushion for releasable attachment of the cushion to an external support, such as a chair or the like. A rigid plate is contained within the cushion, adjacent the fixed end thereof, preventing slippage of the cushion when the multi-functional bag with cushion is supported on a chair back or the like. The cushion is preferably pleated, including a plurality of laterally extending fillable pockets and a plurality of laterally extending pleats separating the laterally extending fillable pockets from one another.

A flap can be secured to the cushion for releasably covering an opening formed through the cushion, allowing the cushion to be used to cover and pad a toilet seat or the like. A pocket can be secured to an upper end of the backpack portion for removably receiving a clamp. The clamp is configured to releasably engage a support surface, such as a chair back, a table or the like. A hat having a head-mounted portion and a tail can be releasably secured to the bag. A free end of the tail is releasably secured to an upper end of the backpack portion. A pocket may be provided on the upper end of the backpack portion for releasably receiving the free end of the tail.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
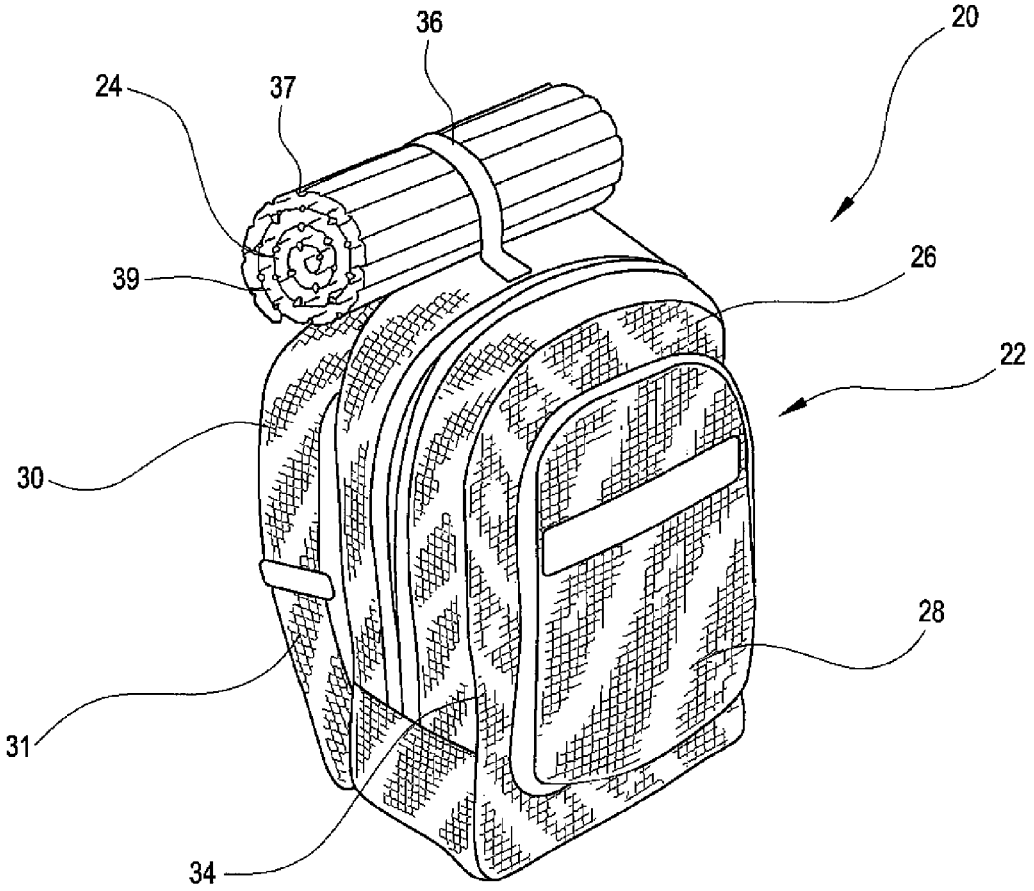
FIG. 1 is a perspective view of a multi-functional bag with cushion according to the present invention.

As shown in FIG. 1, the multi-functional bag with cushion 20 includes a pack assembly 22 and a pleated cushion 24. As shown, the pack assembly 22 includes a front panel 26 behind an outer front pouch 28 and a back panel 30. The pack assembly 22 also includes a pair of shoulder straps 31 and 32 in a conventional manner. Pack assembly 22 is preferably configured as a conventional backpack type of carrying bag, although it should be understood that the particular backpack design and style shown in FIG. 1 is shown for exemplary purposes only, and that pack assembly 22 may have any desired overall style, contouring and relative dimensions.

The pleated cushion 24 attached to a top portion of the back panel 30. The pleated cushion 24 includes pleats 37 and fillable pockets 39, and is attached to the upper portion of the back panel 30 by a row of stitches 35 (see FIG. 3). Pockets 39 can be filled with a sponge-like material. The pleated cushion 24 may be held in place (i.e., in the rolled-up, non-deployed configuration of FIG. 1) by a strap 36 or the like. It should, however, be understood that pleated cushion 24 may be releasably held in place by any suitable type of releasable fastener, such as hook-and-loop fasteners, snaps, or the like.

Figure 2:
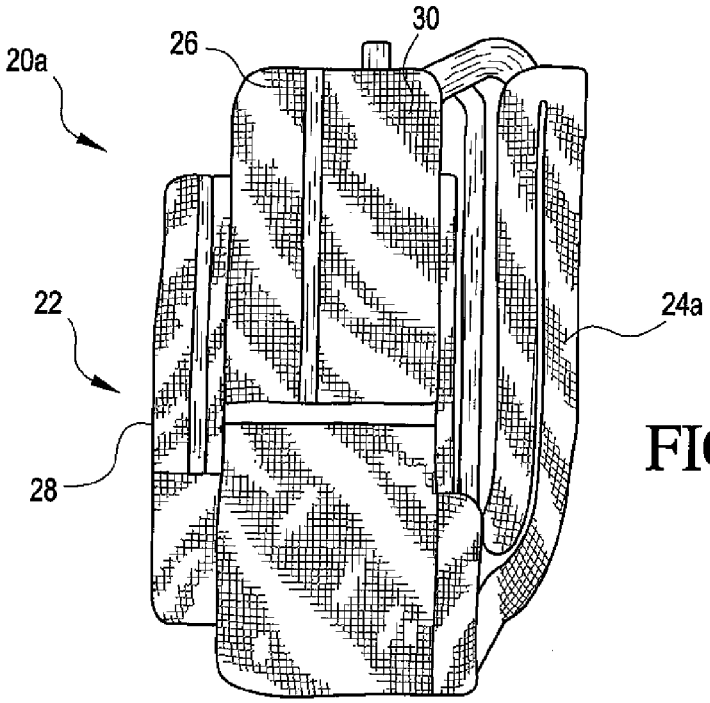
FIG. 2 is a side view of an alternative embodiment of the multi-functional bag with cushion.

FIG. 2 shows an alternative pleated cushion 24*a*, which can be attached to a lower edge 12 of the back panel 30. In this alternative embodiment, rather than being rolled up, the pleated cushion 24*a* is folded against the rear of back panel 30, as shown, providing storage for the folded cushion 24*a* between the back panel 30 and the back of the user when the bag 20*a* is worn like a conventional backpack. It should be understood that pleated cushion 24*a* may be releasably held in place by any suitable type of releasable fastener, such as hook-and-loop fasteners, straps, snaps, or the like.

Figure 3:
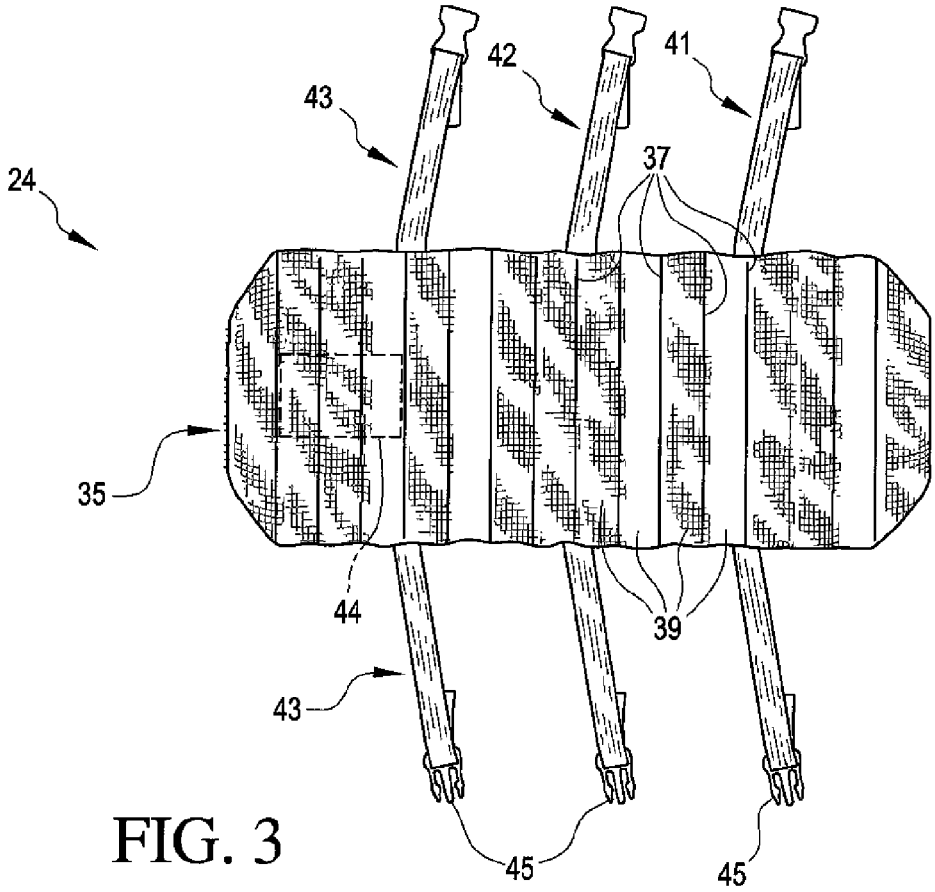
FIG. 3 is a plan view of a cushion of the multi-functional bag with cushion.

In FIG. 3, the pleated cushion 24 is shown as a longitudinally extending mat-like structure with a length of about 90 cm and a width of about 37 cm, however it should be understood that pleated cushion 24 may have any desired contouring and relative dimensions. The pleated cushion 24 includes a plurality of laterally-extending pleats 37 that define a plurality of laterally extending pockets 39. Each of the pockets 39 is filled with an elastomer, such as a medium density sponge like material 40 or the like, and is closed on both ends thereof.

A plurality of belts, such as the exemplary three belts 41, 42, 43 of FIG. 3, are fixed to, and extend outwardly form, the pleated cushion 24 in a direction that is generally perpendicular to the axis of the longitudinal mat and parallel to the transverse pockets 39. Each of the belts is fixed to a back surface of the mat and includes a conventional quick release buckle 45 or the like. For example, the buckle 45 may be plastic with two forwardly extending prongs and a receptacle with an open area on two sides thereof that allow the prongs to be squeezed together toward one another to open the buckle. The buckles 45 may also include a conventional adjustment means, such as a pair of superimposed plates in sliding engagement with one another and openings therein for receiving one end of the belts.

Figure 4:
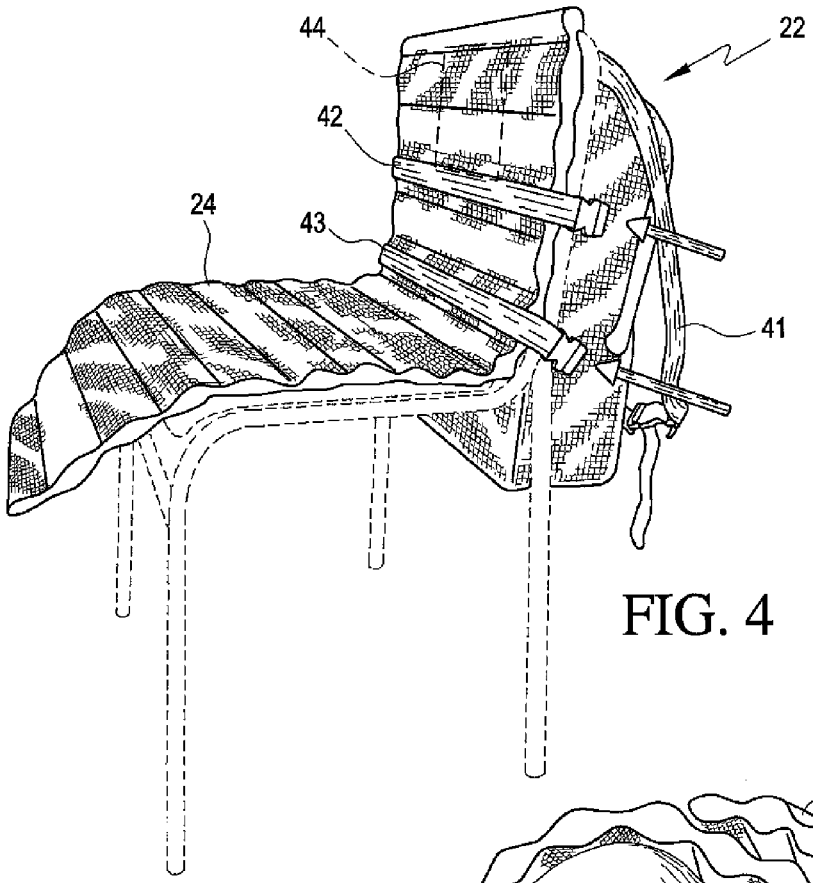
FIG. 4 is an environmental, perspective view of the multi-functional bag with cushion in use with an exemplary chair.

One use of the multi-functional bag with cushion 20 is shown in FIG. 4, where the cushion 24 and pack assembly 22 hang over a chair back with the pack assembly 22 on the back of the chair and the cushion 24 strapped to the front of the chair with the straps or belts 41, 42, and 43. The cushion 24 extends over the seat to create a comfortable padded chair. It should be understood that the chair shown in FIG. 4 is for illustrative and exemplary purposes only.

Further, as shown in FIGS. 3 and 4, a rigid plate 44 is preferably sewn or otherwise received within the cushion 24, adjacent the end of cushion 24 having stitches 35. Since rigid plate 44 is inflexible, it prevents sliding of the cushion 24, particularly under applied weight from materials carried within pack portion 22. Any suitable type of rigid and inflexible material may be used, such as polyvinyl chloride (PVC) or the like. Although shown as having a substantially rectangular contour, with a length of approximately 15 cm, a width of approximately 10 cm, and a thickness of approximately 2 cm, it should be understood that rigid plate 44 may have any desired contouring or relative dimensions.

Figure 5:
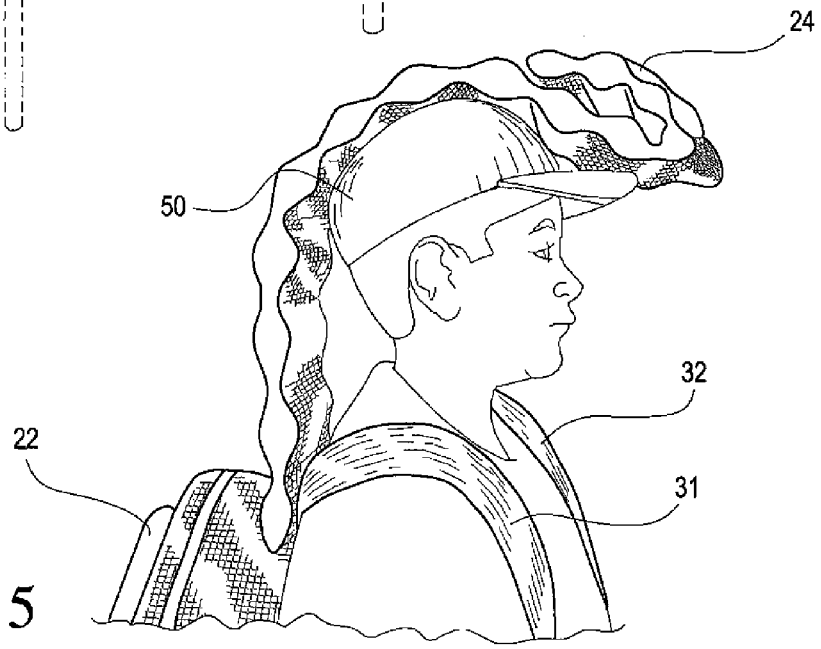
FIG. 5 is an environmental, perspective view of another embodiment of the multi-functional bag with cushion.
Figure 6:
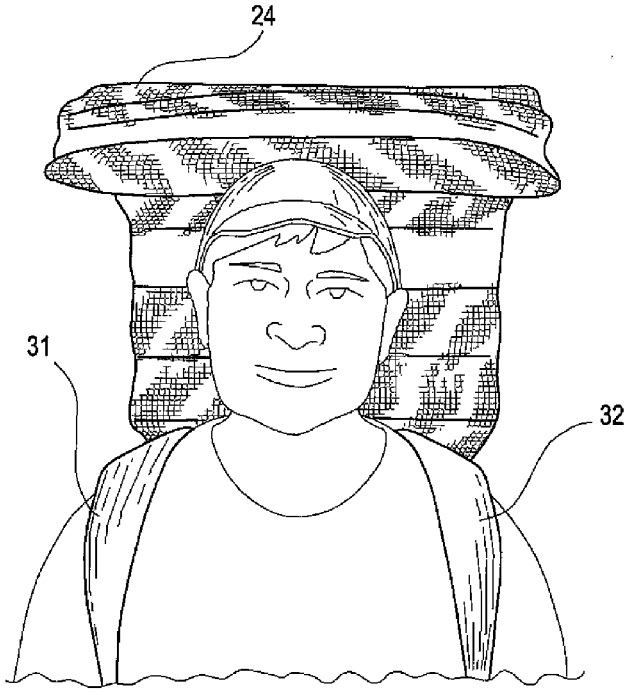
FIG. 6 is a front environmental view of the multi-functional bag with cushion of FIG. 5.
Figure 7:
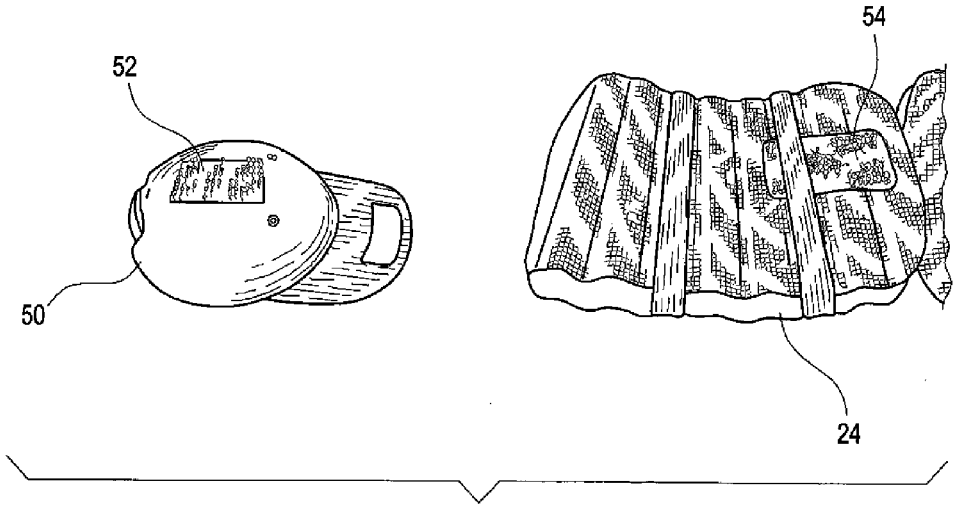
FIG. 7 illustrates a kit portion of the multi-functional bag with cushion of FIG. 5, including the cushion thereof in combination with a hat.

In a further alternative embodiment, as shown in FIGS. 5-7, the pleated cushion 24 can be extended upwardly, forwardly and rearwardly and positioned on top of an individual's head to protect the individual from the sun, rain, sleet or hail. As shown, the multi-functional bag with cushion 20 may be combined with a hat or cap 50 that includes a hook-and-loop pad 52 attached to the top of the hat. The cushion 24 is folded over upon itself and held together by the straps or belts 41, 42, 43 and includes a matching hook-and-loop pad 54 to maintain the cushion 24 on top of an individual's head.

Figure 8:
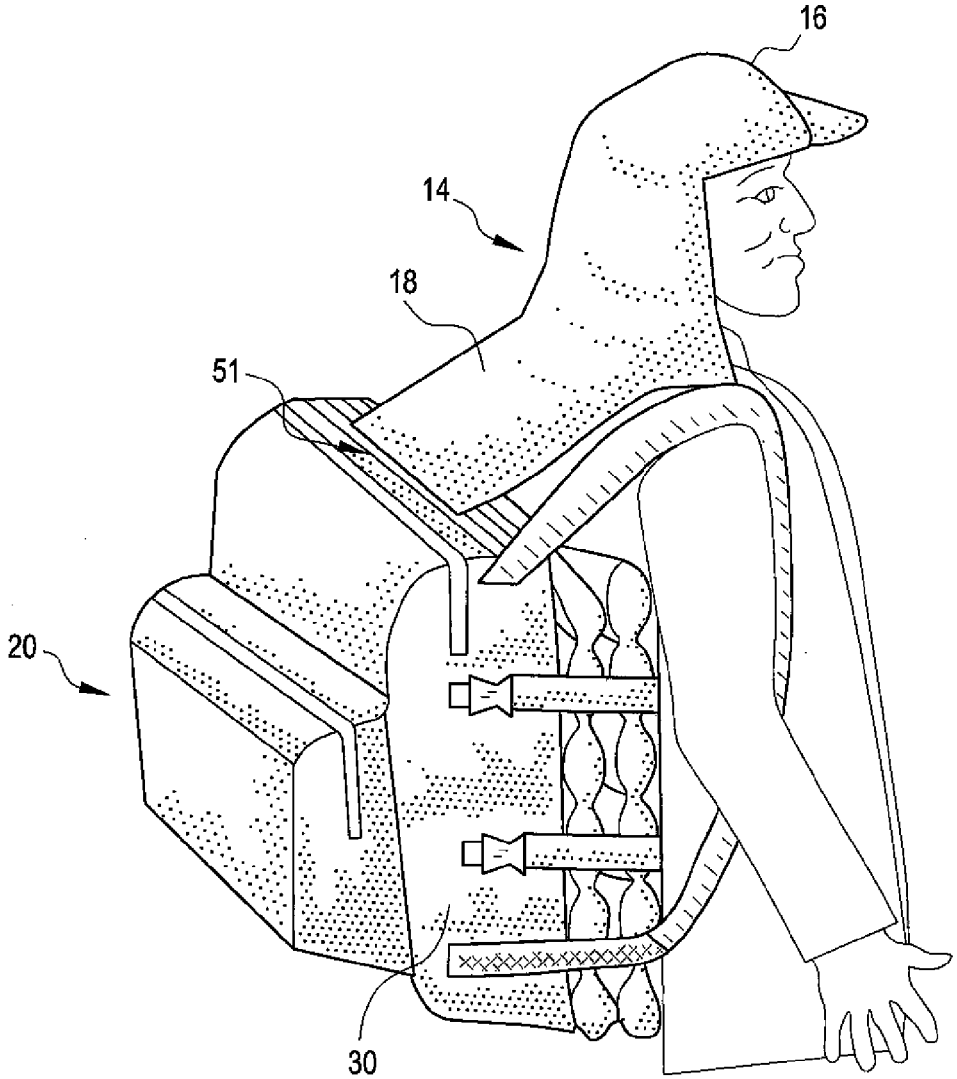
FIG. 8 is an environmental, perspective view of another embodiment of the multi-functional bag.

As a further alternative, as shown in FIG. 8, the multi-functional bag with cushion 20 can include a hat 14 having a head-mounted portion 16 and a tail 18. A pocket 51 is preferably formed on the upper end of back panel 30 for reception of the rear end of tail 18. The tail 18 may be further secured therein by any suitable type of releasable fastener, such as an adhesive, a hook-and-loop type fastener, snaps or the like.

Figure 9A:
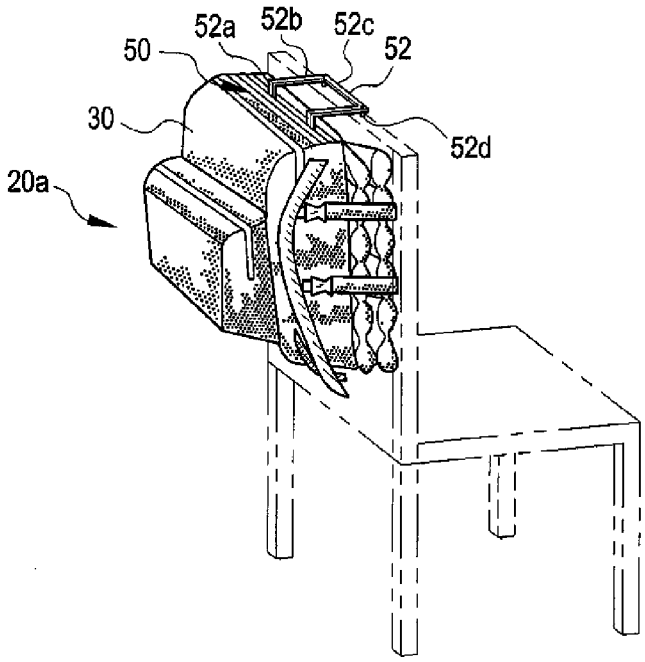
FIG. 9A is an environmental, perspective view of still another embodiment of the multi-functional bag with cushion, shown in use with an exemplary chair.
Figure 9B:
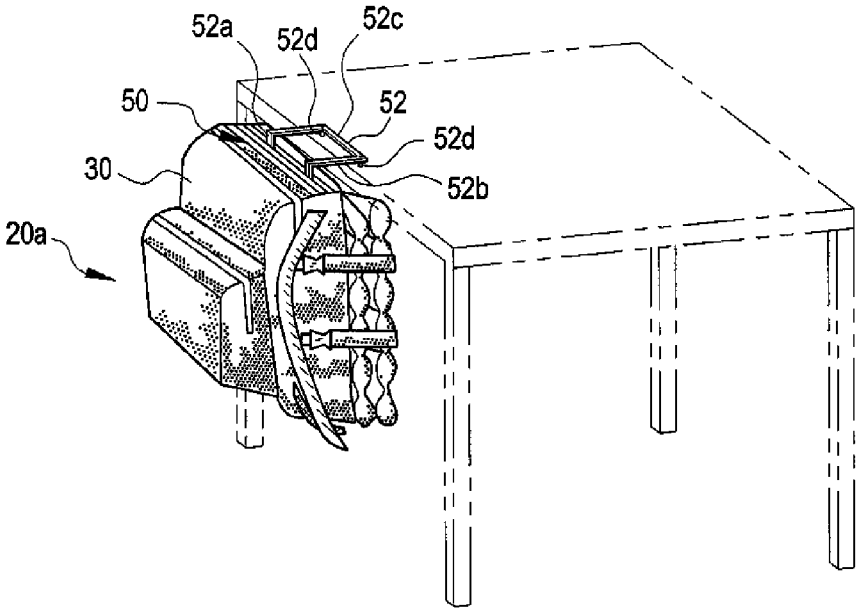
FIG. 9B is an environmental, perspective view of the multi-functional bag with cushion of FIG. 9A, shown in use with an exemplary table.

In the alternative embodiment of FIGS. 9A and 9B, the pocket 50 formed on the upper end of back panel 30, can be used for receiving a clamp 52. A portion of the clamp 52 can extend from pocket 50 and releasably attach to a chair, table or the like. The clamp 52 has a pair of legs 52*a* secured within the pocket 50. A pair of arms 52*b* extending normally from the pair of legs 52*a*. A cross bar 52*c* extending between the ends of the pair of arms 52*b*. At least a pair of feet 52*d* disposed on an underside of the cross bar 52*c*, for securing the clamp 52 to a supporting object.

Figure 10:
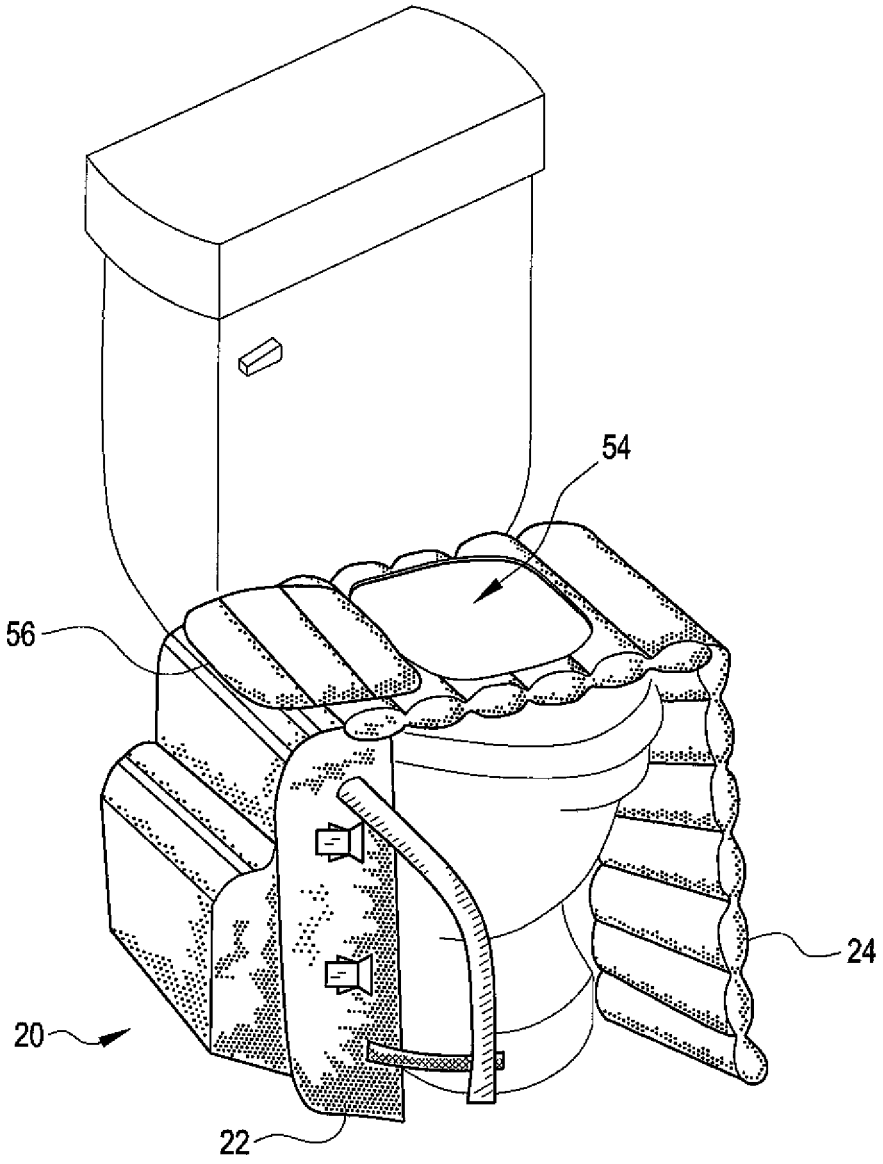
FIG. 10 is an environmental, perspective view of yet another embodiment of the multi-functional bag with cushion.

As a further alternative, as shown in FIG. 10, a flap 56 may be provided for covering an opening 54 formed through cushion 24. As shown, this allows the cushion 24 to be used to cover and pad a conventional toilet seat or the like. Flap 56 releasably seals and covers opening 54, and may include any suitable type of releasable fasteners, such as snaps, hook-and-loop type fasteners or the like.

It is to be understood that the present invention is not limited to the embodiments described above, but encompasses any and all embodiments within the scope of the following claims.

I claim:

1. A multi-functional bag with cushion, comprising:

a backpack portion having a front panel and a rear panel defining an open interior region;

a pair of shoulder straps secured to the rear panel;

a first pocket secured to an upper end of the backpack portion;

a clamp removably received within the first pocket for supporting the backpack portion on a support surface;

wherein the clamp has a pair of legs secured within the first pocket, a pair of arms extending normally from the pair of legs, a cross bar coupled between the pair of arms, and at least two feet disposed on an underside of the cross bar;

a hat having a head-mounted portion and a tail, a free end of the tail being releasably secured to the upper end of the backpack portion;

a cushion having a fixed end and a free end, the fixed end thereof being secured to a top end of the rear panel, at least one belt extending from the cushion for releasable attachment of the cushion to an external support; and a rigid plate contained within the cushion adjacent the fixed end thereof.

2. The multi-functional bag with cushion as recited in claim 1, wherein the cushion comprises a plurality of laterally extending fillable pockets and a plurality of laterally extending pleats separating the laterally extending fillable pockets from one another.

3. The multi-functional bag with cushion as recited in claim 1, wherein the at least one belt comprising a plurality of belts configured to secure the cushion in a stowed position adjacent to the rear panel of the backpack portion.

4. The multi-functional bag with cushion as recited in claim 1, further comprising a flap secured to the cushion for releasably covering an opening formed through said cushion.

5. The multi-functional bag as recited in claim 1, further comprising a second pocket secured to the upper end of the backpack portion for receiving the free end of the tail.

* * * * *